US007029090B2

(12) United States Patent
Nishida et al.

(10) Patent No.: US 7,029,090 B2
(45) Date of Patent: Apr. 18, 2006

(54) INK JET HEAD CLEANING APPARATUS AND INK JET RECORDING APPARATUS

(75) Inventors: Hideaki Nishida, Shizuoka (JP); Hidekazu Ishii, Shizuoka (JP); Kazuhisa Kimura, Hiratsuka (JP); Hideyuki Akaba, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/121,380

(22) Filed: May 3, 2005

(65) Prior Publication Data

US 2005/0190229 A1 Sep. 1, 2005

Related U.S. Application Data

(62) Division of application No. 10/465,112, filed on Jun. 19, 2003, now abandoned.

(51) Int. Cl.
*B41J 2/165* (2006.01)

(52) U.S. Cl. ..... 347/23; 347/30

(58) Field of Classification Search ..... 347/23, 347/30

See application file for complete search history.

(56) References Cited

U.S. PATENT DOCUMENTS

| | | | |
|---|---|---|---|
| 4,380,770 | A | 4/1983 | Maruyama |
| 4,829,318 | A | 5/1989 | Racicot et al. |
| 5,126,765 | A | 6/1992 | Nakamura |
| 5,231,424 | A | 7/1993 | Kaneko et al. |
| 5,534,897 | A | 7/1996 | Anderson et al. |
| 5,543,826 | A | 8/1996 | Kuronuma et al. |
| 5,557,306 | A | 9/1996 | Fukushima et al. |
| 5,612,722 | A | 3/1997 | Francis et al. |
| 5,699,095 | A | 12/1997 | Mitsuzawa et al. |
| 5,706,038 | A | 1/1998 | Jackson |
| 5,793,390 | A | 8/1998 | Claflin et al. |
| 5,805,180 | A | 9/1998 | Ebisawa et al. |

(Continued)

FOREIGN PATENT DOCUMENTS

| | | | |
|---|---|---|---|
| EP | 0 318 329 | A2 | 5/1989 |

(Continued)

OTHER PUBLICATIONS

Related U.S. Appl. No. 10/716,899, filed Nov. 18, 2003; Inventor: Kazuhisa Kimura et al.; Title: Ink Jet Recording Head Maintenance Apparatus and Ink Jet Recording Apparatus.

(Continued)

*Primary Examiner*—Stephen D. Meier
*Assistant Examiner*—Ly T Tran
(74) *Attorney, Agent, or Firm*—Frishauf, Holtz, Goodman & Chick, P.C.

(57) ABSTRACT

An ink jet head cleaning apparatus is provided which includes a wiping unit which performs a wiping operation for a nozzle surface of an ink jet head and a suction unit which performs a sucking operation for the nozzle surface. An operation OFF condition of the wiping unit and an operation OFF condition of the suction unit is detected, and the wiping unit and the suction unit are actuated selectively in accordance with the operation OFF condition thus detected. If an elapsed time after the wiping operation is longer than a first predetermined time, the wiping unit is actuated, and if an elapsed time after the sucking operation is longer than a second predetermined time, the suction unit is actuated. The first predetermined time is longer than the second predetermined time.

4 Claims, 9 Drawing Sheets

U.S. PATENT DOCUMENTS

| | | | | |
|---|---|---|---|---|
| 5,886,714 | A | 3/1999 | Burnet et al. | |
| 5,953,025 | A | 9/1999 | Sakurai | |
| 6,000,792 | A | 12/1999 | Koizumi et al. | |
| 6,024,432 | A | 2/2000 | Aruga et al. | |
| 6,120,126 | A | 9/2000 | Nakahara | |
| 6,260,944 | B1 | 7/2001 | Mochizuki et al. | |
| 6,283,573 | B1 * | 9/2001 | Nakamura | 347/23 |
| 6,334,662 | B1 | 1/2002 | Hollands | |
| 6,386,677 | B1 * | 5/2002 | Imai et al. | 347/23 |
| 6,550,890 | B1 | 4/2003 | Saijo | |
| 6,631,974 | B1 | 10/2003 | Shindo | |
| 6,637,855 | B1 * | 10/2003 | Ide et al. | 347/23 |
| 6,641,247 | B1 | 11/2003 | Ide et al. | |
| 6,746,097 | B1 * | 6/2004 | Im et al. | 347/23 |
| 2004/0100520 | A1 | 5/2004 | Kimura | |
| 2004/0189734 | A1 | 9/2004 | Ishii et al. | |
| 2004/0189735 | A1 | 9/2004 | Ishii et al. | |
| 2004/0189741 | A1 | 9/2004 | Kimura et al. | |
| 2004/0189742 | A1 | 9/2004 | Kimura et al. | |
| 2005/0104925 | A1 | 5/2005 | Kimura | |

FOREIGN PATENT DOCUMENTS

| | | | |
|---|---|---|---|
| EP | 0 499 432 | A2 | 8/1992 |
| EP | 0 513 833 | A2 | 11/1992 |
| EP | 0 972 644 | A1 | 1/2000 |
| EP | 1 029 684 | A1 | 8/2000 |
| EP | 1 043 161 | A2 | 10/2000 |
| JP | 62-101448 | A | 5/1987 |
| JP | 02-006142 | | 1/1990 |
| JP | 02-095862 | A | 4/1990 |
| JP | 02-179757 | A | 7/1990 |
| JP | 03-099857 | A2 | 4/1991 |
| JP | 4-70355 | A | 3/1992 |
| JP | 05-201014 | A | 8/1993 |
| JP | 05-201028 | A | 8/1993 |
| JP | 05-220970 | A | 8/1993 |
| JP | 06-071904 | A | 3/1994 |
| JP | 06-135004 | A | 5/1994 |
| JP | 09-076517 | A | 3/1997 |
| JP | 10-119311 | A | 5/1998 |
| JP | 2000-127417 | A | 5/2000 |
| JP | 2000-177113 | | 6/2000 |
| JP | 2000-177113 | A | 6/2000 |
| JP | 2000-280494 | A | 10/2000 |
| JP | 3161050 | B2 | 2/2001 |
| JP | 2001-219567 | A | 8/2001 |
| JP | 2001-260368 | A | 9/2001 |
| JP | 2002-283590 | A | 10/2002 |

OTHER PUBLICATIONS

Merriam-Webster's Collegiate Dictionary, 10th Edition, p. 811.

* cited by examiner

INK JET HEAD CLEANING APPARATUS AND INK JET RECORDING APPARATUS

CROSS-REFERENCE TO RELATED APPLICATION

The present application is a Divisional application of U.S. application Ser. No. 10/465,112, filed Jun. 19, 2003 now abandoned.

BACKGROUND OF THE INVENTION

1. Field of the Invention

The present invention relates to an ink jet cleaning apparatus for cleaning an ink jet head which has a nozzle surface provided with orifices and which causes ink to be ejected from the orifices, as well as an ink jet recording apparatus provided with the ink jet head.

2. Discussion of the Background

An ink jet recording apparatus is provided with an ink jet head for ejecting ink as ink droplets from orifices formed in a nozzle surface toward a recording medium, with an image being recorded on the recording medium by the ink jet head. In such an ink jet recording apparatus, the ink jet head approaches the recording medium in a recording operation, so that the scattering of ink which is attributable to collision of ink droplets with the recording medium may contaminate the nozzle surface of the ink jet head. Particularly, in an on-demand type ink jet recording apparatus, ink droplet discharge energy is small, besides, the ink jet head is spaced several millimeters or so from the recording medium, so that the nozzle surface is apt to be contaminated by scattered ink, with consequent clogging of nozzles. Once there occurs nozzle clogging, it is difficult to clear up the clogging because pressure force for discharging the ink from the nozzle is small.

For preventing or avoiding the occurrence of such nozzle clogging there have been proposed a suction technique wherein all of plural orifices are hermetically sealed with a cap and a partial suction technique wherein orifices are partially subjected to suction (see Japanese Patent No. 3161050). There also has been proposed a technique wherein a nozzle surface is wiped using a cleaning member to remove ink and coagulations remaining on the nozzle surface (see Japanese Published Unexamined Patent Application No. 10-119311). Further, there has been proposed a technique wherein the number of times of wiping operations is changed according to an elapsed time after a sucking operation (see Japanese Published Unexamined Patent Application No. 2001-219567).

However, even in case of using any of the above suction techniques, there sometimes occurs a case where ink remains on the nozzle surface after the sucking operation, with the nozzle surface being contaminated. Such contamination of the nozzle surface results in adhesion to the same surface of fibers contained in the recording medium, as well as dust and dirt, causing nozzle clogging in a long period of use of the ink jet head, with consequent deterioration of ink jet stability for example. In case of using a suction technique, moreover, it is necessary that the sucking operation be carried out frequently in order to maintain the nozzle surface in a satisfactory condition. Consequently, there arises the problem that the energy consumption is high and a recording operation (printing operation) cannot be performed during each of frequent sucking operations.

Although the wiping technique is highly effective in removing foreign matters and coagulations adhered to the nozzle surface, there is a fear of the nozzle surface becoming worn due to contact therewith of a wiping member or damaged due to dragging of foreign matters or coagulations, which would deteriorate the nozzle surface condition or shorten the life of the ink jet head.

SUMMARY OF THE INVENTION

Accordingly, it is an object of the present invention to provide an ink jet head cleaning apparatus and an ink jet recording apparatus both capable of suppressing energy consumption, preventing the deterioration of ink jet stability and attaining a long life of an ink jet head.

The above object of the present invention is achieved by novel ink jet head cleaning apparatus and ink jet recording apparatus of the present invention.

The novel ink jet head cleaning apparatus according to the present invention comprises a wiping unit adapted to perform a wiping operation for a nozzle surface of an ink jet head which ejects ink as an ink droplet from an orifice formed in the nozzle surface, a suction unit adapted to perform a sucking operation for the nozzle surface of the ink jet head, a detector means for detecting an operation OFF condition of the ink jet head, the wiping unit or the suction unit, and a drive means for actuating the wiping unit and the suction unit selectively in accordance with the operation OFF condition detected by the detector means.

The novel ink jet recording apparatus according to the present invention comprises an ink jet head having a nozzle surface formed with an orifice and adapted to eject ink as an ink droplet from the orifice, a wiping unit adapted to perform a wiping operation for the nozzle surface of the ink jet head, a suction unit adapted to perform a sucking operation for the nozzle surface of the ink jet head, a detector means for detecting an operation OFF condition of the ink jet head, the wiping unit or the suction unit, and a drive means for actuating the wiping unit and the suction unit selectively in accordance with the operation OFF condition detected by the detector means.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF A PREFERRED EMBODIMENT

Figure 1:
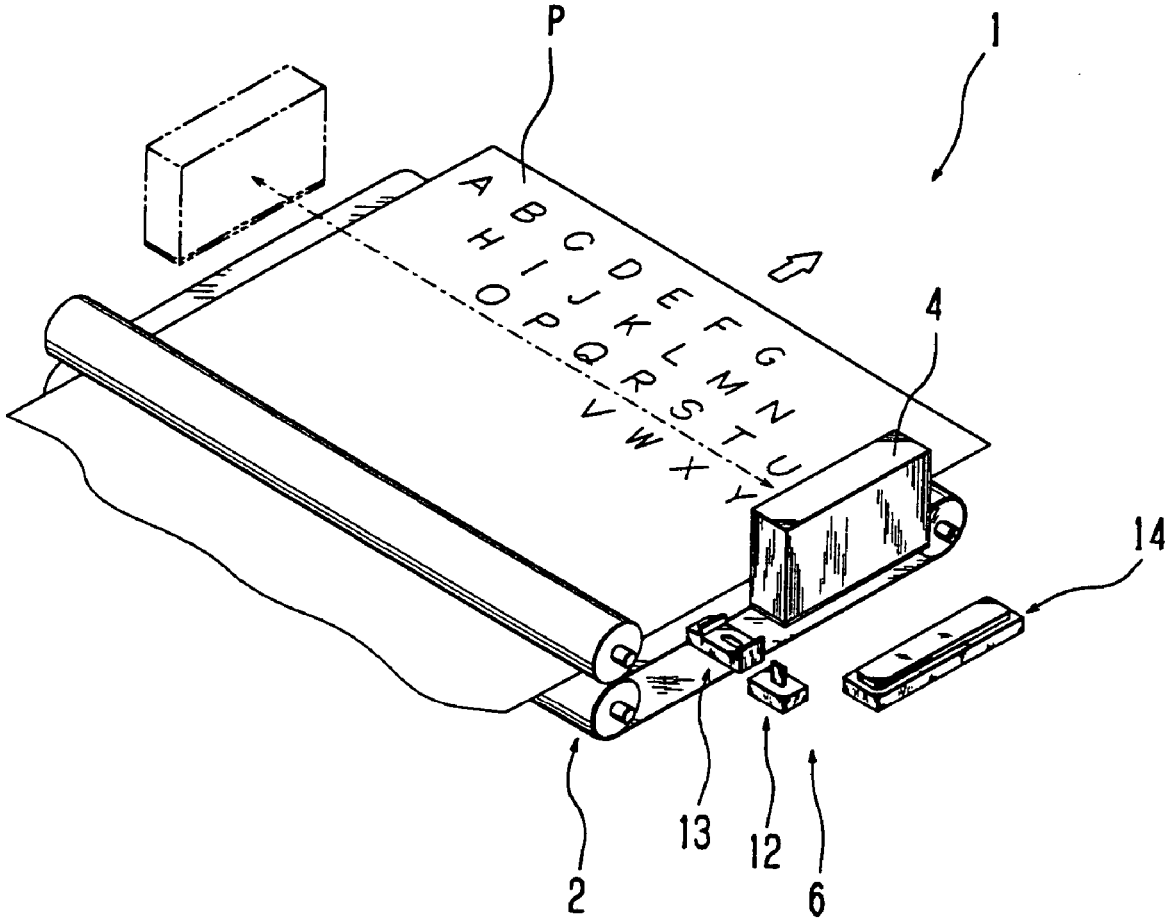
FIG. 1 is a perspective view showing schematically an ink jet recording apparatus according to an embodiment of the present invention.
Figure 2:
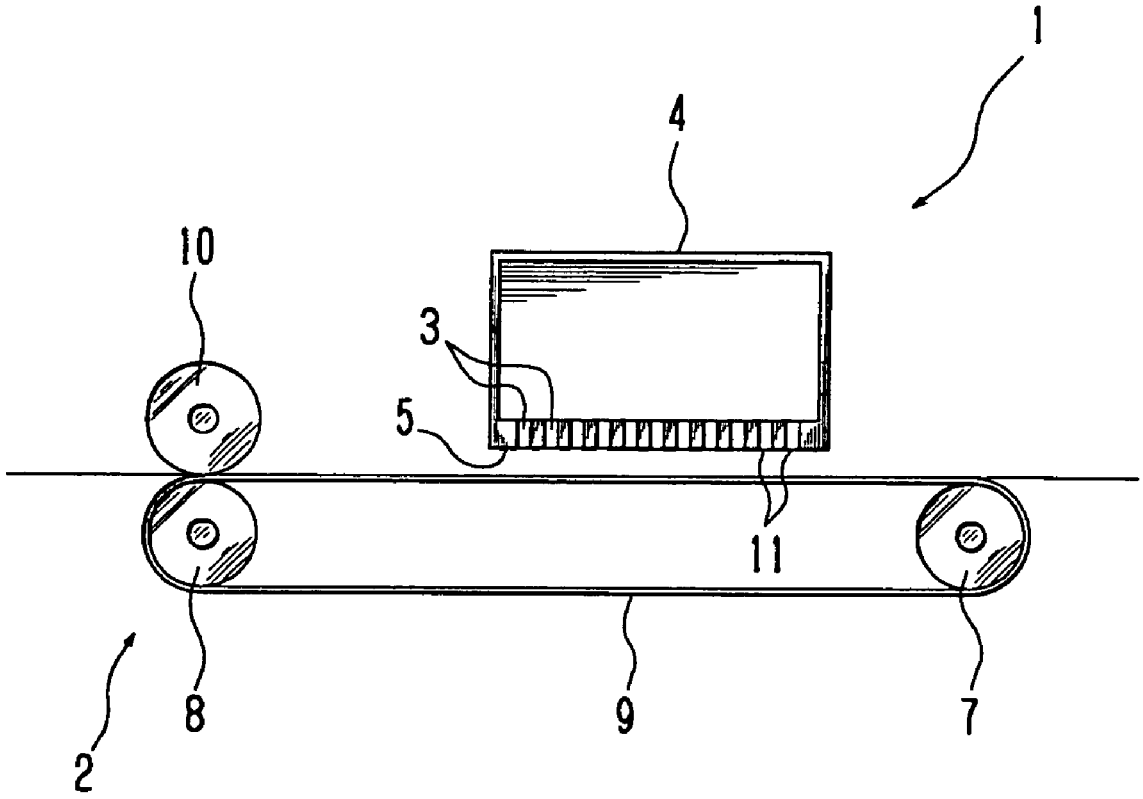
FIG. 2 is a side view in vertical section, showing the ink jet recording apparatus schematically.
Figure 3:
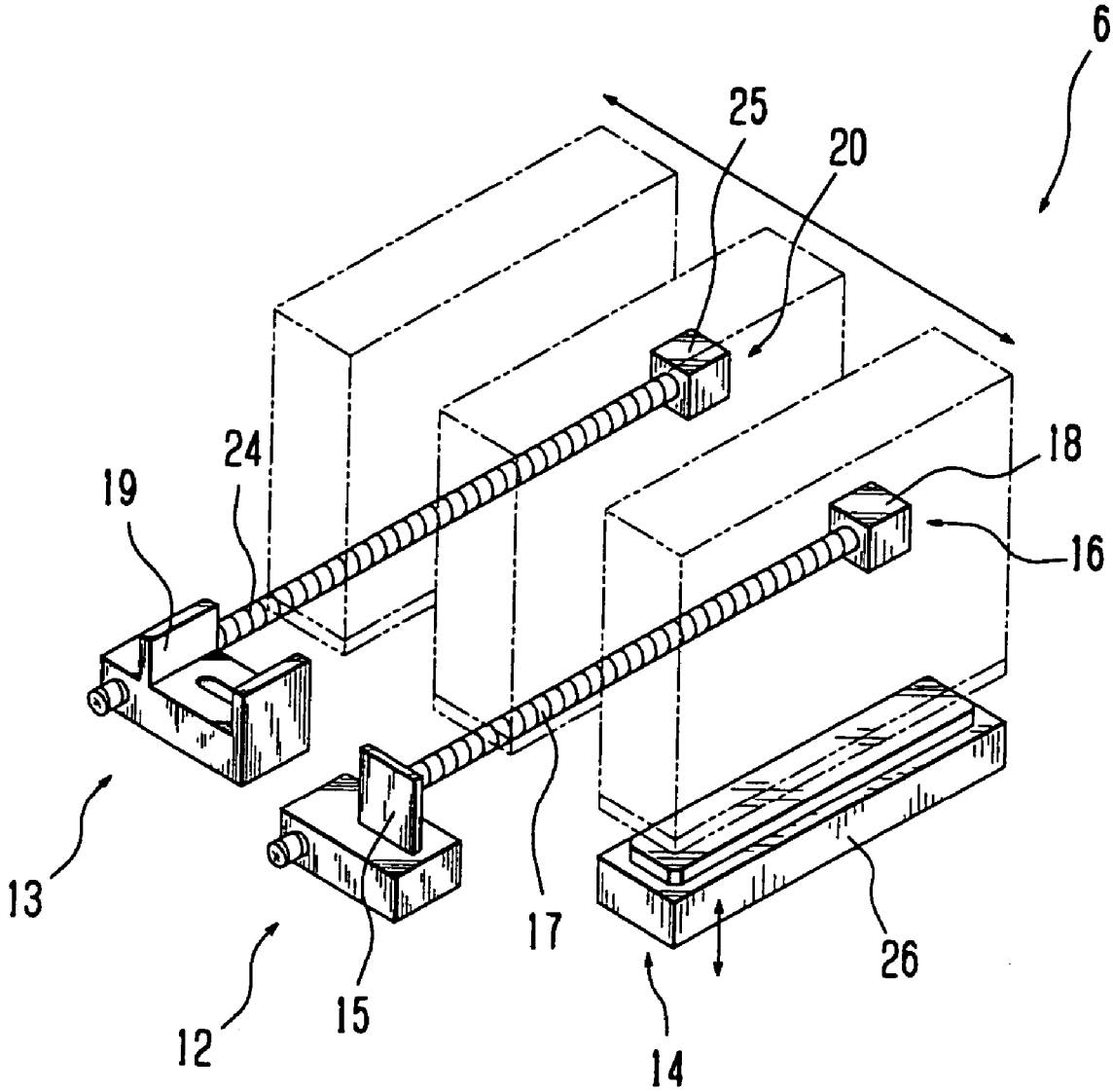
FIG. 3 is a perspective view schematically showing a cleaning section provided in the ink jet recording apparatus.
Figure 4:
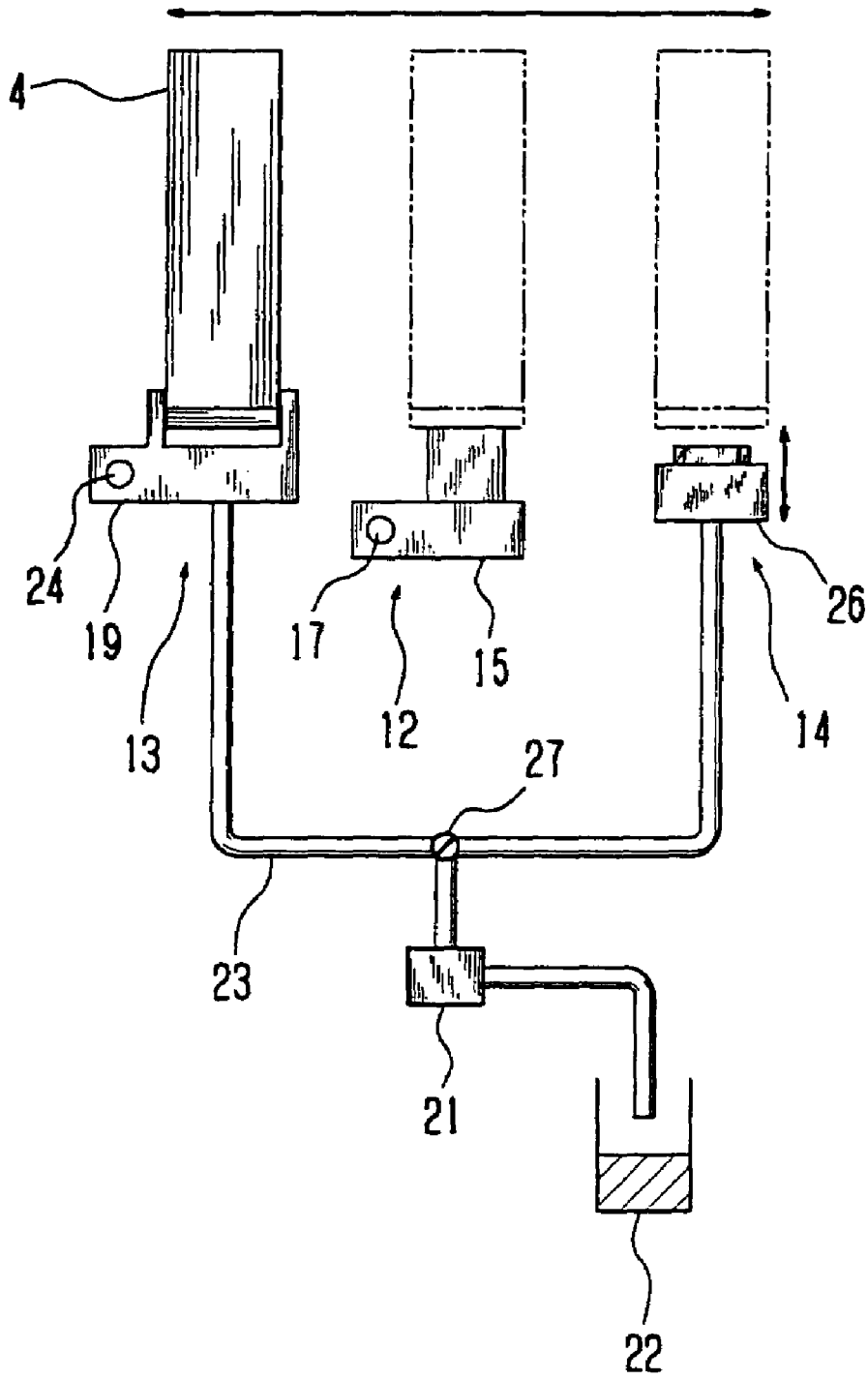
FIG. 4 is a side view thereof.

An embodiment of the present invention will be described in detail hereinunder with reference to the accompanying drawings. This embodiment is an application example in which an ink jet head cleaning apparatus according to the present invention is applied to an ink jet recording apparatus according to the present invention. FIG. 1 is a perspective view showing schematically the ink jet recording apparatus of this embodiment, indicated at 1, FIG. 2 is a side view in vertical section, showing the ink jet recording apparatus schematically, FIG. 3 is a perspective view showing schematically a cleaning section provided in the ink jet recording apparatus, and FIG. 4 is a side view thereof.

The ink jet recording apparatus 1 is provided with a recording medium conveying section 2 for delivering paper P or the like as a recording medium in a successive manner and conveying it in a vertical scanning direction, an ink jet head 4 adapted to move in a horizontal scanning direction to let ink be ejected as ink droplets from nozzles 3 to the paper P, a cleaning section 6 for cleaning a nozzle surface 5 in the ink jet head 4, and an ink tank (not shown) for the storage of ink, the ink tank being connected to the ink jet head 4 through an ink feed path (not shown).

The recording medium conveying section 2 is made up of a driving roller 7, a driven roller 8, a conveyor belt 9 stretched between and entrained on both driving roller 7 and driven roller 8 to convey the paper P, and a rotating roller 10 opposed to the driven roller 8 through a paper conveying path.

The ink jet head 4 is provided with plural nozzles 3 which are substantially aligned on a straight line. Consequently, in the nozzle surface 5 are formed orifices 11 of the plural nozzles 3 in a substantially aligned manner. Thus, the ink jet head 4 is constructed so that ink is ejected as ink droplets from the orifices 11 formed in the nozzle surface 5. The ink jet head 4 of such a construction is mounted on a carriage (not shown) which is movable in the horizontal scanning direction, and moves in the horizontal scanning direction with movement of the carriage. As the ink jet head 4 there is used, for example, a piezoelectric type ink jet head which utilizes a piezoelectric element or a thermal ink jet head which utilizes a heater.

The cleaning section 6 is made up of a wiping unit 12 which performs a wiping operation for the nozzle surface 5, a suction unit 13 which performs a sucking operation for the nozzle surface 5, and a maintenance unit 14 which performs a maintenance operation for the ink jet head 4. The ink jet recording apparatus 1 causes the ink jet head 4 to move to a wiping position opposed to the wiring unit 12 and thereafter causes the wiping unit 12 to perform a wiping operation. Likewise, the ink jet recording apparatus 1 causes the ink jet head 4 to move to a sucking position opposed to the suction unit 13 and thereafter causes the suction unit 13 to perform a sucking operation. Further, the ink jet recording apparatus 1 causes the ink jet head 4 to move to a maintenance position opposed to the maintenance unit 14 and thereafter causes the maintenance unit 14 to perform a maintenance operation. These positions are predetermined stop positions of the ink jet head 4.

The wiping unit 12 is made up of a wiping blade 15 which is located at a position at which its front end portion comes into abutment against the nozzle surface 5 of the ink jet head 4 stopped at the wiping position and which is movable along the nozzle surface 5 (for example in the aligned direction of the plural orifices 11), and a first moving driver 16 which causes the wiping blade 15 to move in the aligned direction of orifices 11. The wiping blade 15 functions as an abutting member. The first moving driver 16 is made up of a guide screw 17 for guiding and moving the wiping blade 15 in the aligned direction of the plural orifices 11 (nozzles 3) and a first drive motor 18 for rotating the guide screw 17.

In the wiping unit 12 of such a construction, the wiping blade 15 is moved in the aligned direction of the plural orifices 11 (nozzles 3) by the first moving driver 16 while allowing its front end portion to be abutted against the nozzle surface 5, whereby a wiping operation is performed for the nozzle surface 5 of the ink jet head 4 when stopped at the wiping position, to remove foreign matters and coagulations adhered to the nozzle surface.

The suction unit 13 is made up of a suction head 19 which covers part of the plural orifices 11 of the ink jet head 4 when stopped at the sucking position, a second moving driver 20 which causes the suction head 19 to move in the aligned direction of the plural orifices 11 (nozzles 3), a suction pump 21 which generates a suction force for sucking ink from the nozzles 3 and the nozzle surface 5, and a waste ink tank 22 connected through an ink discharge path 23 to store the sucked ink therein. The second moving driver 20 is made up of a guide screw 24 for guiding and moving the suction head 19 in the aligned direction of the plural orifices 11 and a second drive motor 25 for rotating the guide screw 24.

In the suction unit 13 of such a construction, the suction head 19 is moved in the aligned direction of the plural orifices 11 (nozzles 3) by the second moving driver 20 to perform a sucking operation for the nozzle surface 5 of the ink jet head 4 when stopped at the sucking position, whereby ink is sucked from the nozzle surface.

The maintenance unit 14 is made up of an ink receptor 26 for covering and hermetically sealing all of the nozzles 3, the ink receptor 26 being movable into contact with and away from the nozzle surface 5 of the ink jet head 4 when stepped at the maintenance position, the suction pump 21 which generates a suction force for sucking ink from the nozzles 3 and the nozzle surface 5, and the waste ink tank 22 connected through the ink discharge path 23 to store the sucked ink. The maintenance unit 14 is provided with a moving mechanism (not shown) for moving the ink receptor 26 into contact with and away from the nozzle surface 5.

The maintenance unit 14 of such a construction performs a maintenance operation. More specifically, the ink jet head 4 when stopped at the maintenance position is allowed to make a blank ejection of ink from the nozzles 3, or the ink receptor 26 is brought into contact with the nozzle surface 5 by the moving mechanism, followed by suction in a hermetically sealed state. As a result, ink and coagulations which contribute to the clogging of nozzles 3 are removed.

The suction pump 21 and the waste ink tank 22 are used in common by both suction unit 13 and maintenance unit 14. Therefore, in the ink discharge path 23 is disposed a change-over valve 27 for providing communication of the suction unit 13 and the maintenance unit 14 with the suction pump 21 selectively. As the change-over valve 27 there is used an electromagnetic valve for example. Although the suction pump 21 and the waste ink tank 22 are used in common by the suction unit 13 and the maintenance unit 14, this constitutes no limitation. For example, the suction pump 21 and the waste ink tank 22 may be provided separately for each of the suction unit 13 and the maintenance unit 14.

Figure 5:
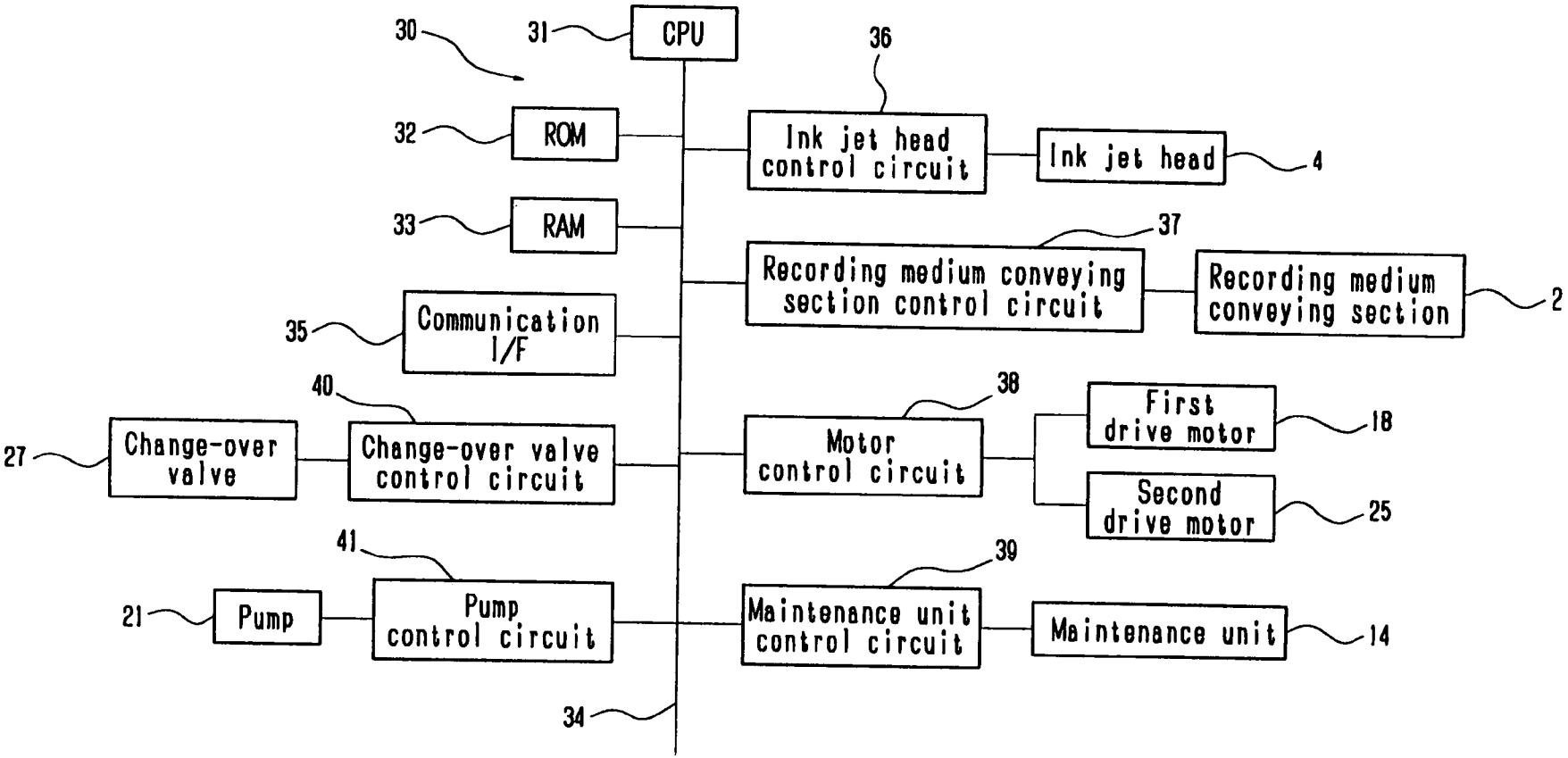
FIG. 5 is a block diagram schematically showing electric connections among various component in the ink jet recording apparatus.

FIG. 5 is a block diagram showing schematically electric connections of various components provided in the ink jet recording apparatus 1 of this embodiment. The ink jet recording apparatus 1 incorporates a controller 30. The controller 30 is constituted by interconnecting through a bus line 34 a CPU (Central Processing Unit) 31 which controls various components in a centralized manner, a ROM (Read Only Memory) 32 which stores various control programs to be executed by CPU 31, and a RAM (Random Access Memory) 33 which functions as a work area of CPU 31.

To the CPU 31 is connected an external device (not shown) such as a personal computer through a communication I/F (interface) 35. To the CPU 31 are also connected the ink jet head 4 through an ink jet head control circuit 36, the recording medium conveying section 2 through a recording medium conveying section control circuit 37, and a carriage (not shown) through a carriage control circuit (not shown). To the CPU 31 are further connected the first and second drive motors 18, 25 through a motor control circuit 38, the maintenance unit 14 through a maintenance unit control circuit 39, the change-over valve 27 through a change-over valve control circuit 40, and the suction pump 21 through a pump control circuit 41.

In the ink jet recording apparatus 1, on the basis of image data received from an external device through the communication I/F 35, the carriage with the ink jet head 4 mounted thereon is moved in the horizontal scanning direction from a home position (e.g., maintenance position) while the paper P as a recording medium is conveyed in the vertical scanning direction by the recording medium conveying section 2, and there is performed a printing operation of recording (forming) image on the recording medium by controlling the operation of the ink jet head 4.

Next, in accordance with the programs stored in the ROM 32 the CPU 31 in the ink jet recording apparatus 1 makes control to let the cleaning section 6 perform a cleaning process of cleaning the nozzle surface 5 of the ink jet head 4. This cleaning process will be described below with reference to FIGS. 6 to 11.

Reference will first be made to the following terms used herein.

Maintenance: Maintenance operation performed by the maintenance unit 14 (blank ejection of ink and sealed suction by the ink receptor 26 are conducted).

Rub cleaning: Wiping operation is performed by the wiping unit 12.

Suction cleaning: Sucking operation is performed by the suction unit 13.

TA: Elapsed time after rub cleaning of the last time

TB: Elapsed time after maintenance of the last time

TC: Elapsed time after suction cleaning of the last time

T1, T2, T3, T4, T5, and T6 represent predetermined times set prior to shipping in factory. The CPU 31 measures TA, TB, and TC in accordance with a program stored in ROM 32. Thus there is realized a function as a detector means. That is, by measuring TA, TB, and TC, operation OFF conditions of the wiping unit 12, maintenance unit 14 and suction unit 13, are respectively detected.

Although in this embodiment T1, T2, T3, T4, T5, and T6 are preset before shipping in factory, this constitutes no limitation. For example, they may be set by an operator's operation for an operating unit (not shown) provided in the ink jet recording apparatus 1. In rub cleaning, the wiping operation by the wiping unit 12 is performed while keeping the nozzle surface 5 wet with ink or the like, whereby it is possible to prevent deterioration in surface condition of the nozzle surface 5 caused by rubbing of the same surface against the wiping unit 12. As a result, it is possible to attain a long life of the ink jet head 4.

Figure 6:
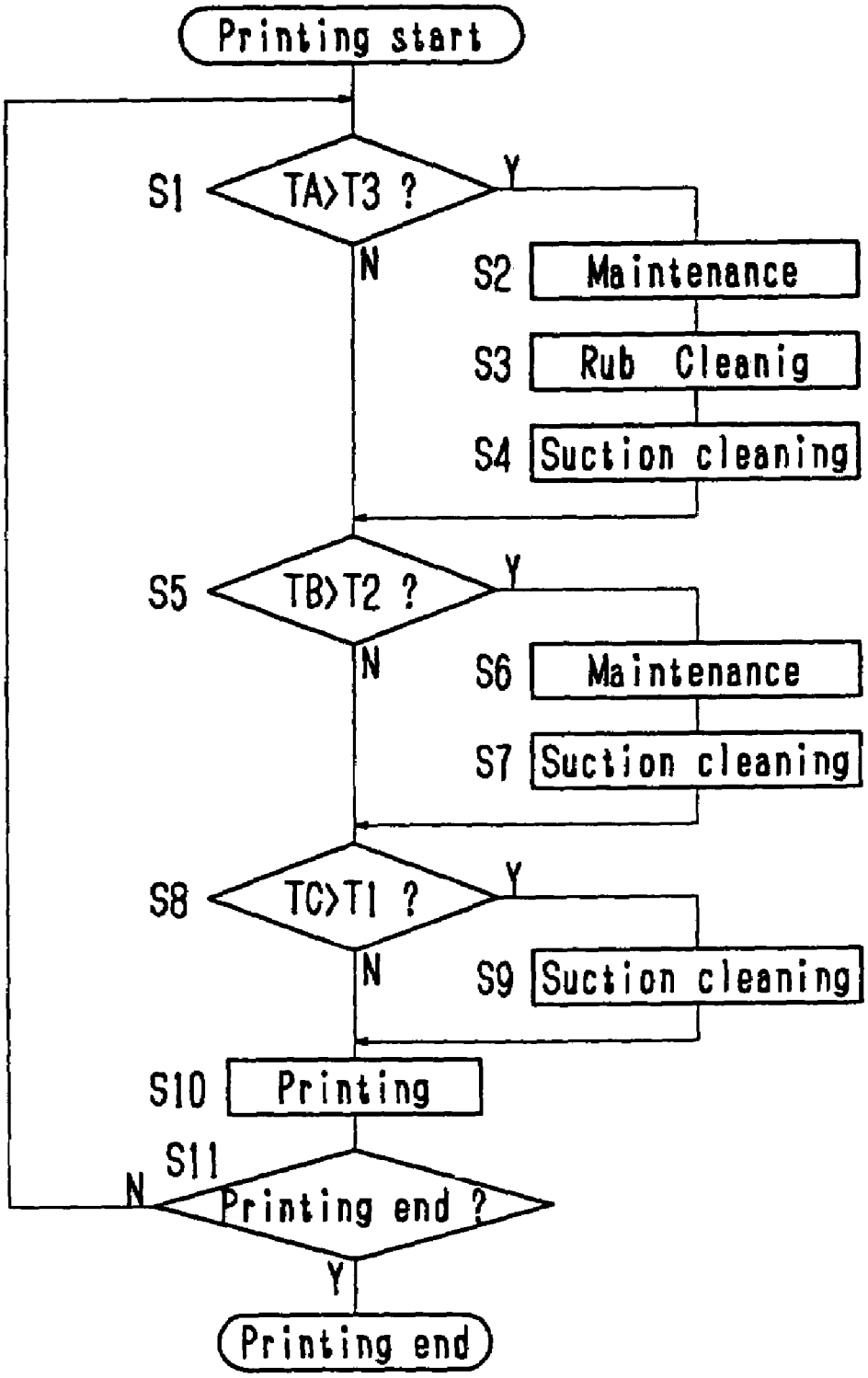
FIG. 6 is a flow chart showing a flow of a cleaning process during printing.

First, with reference to FIG. 6, a description will be given of the cleaning process which the CPU 31 executes in accordance with a program during printing. FIG. 6 is a flow chart showing a flow of the cleaning process during printing.

The CPU 31 determines whether TA is larger than T3 (step S1). Here there is executed a part of the function as drive means. If the CPU 31 determines that TA is larger than T3 (Y in S1), it executes maintenance (S2), rub cleaning (S3), and suction cleaning (S4). Here there is executed a part of the function as drive means. Although suction cleaning is executed in step S4, this constitutes no limitation. For example, suction cleaning may be omitted. Thereafter, the CPU 31 determines whether TB is larger than T2 (S5). Also when the CPU 31 determines that TA is smaller than T3 (N in S1), it determines whether TB is larger than T2 (S5).

If the CPU 31 determines that TB is larger than T2 (Y in S5), it executes maintenance (S6) and suction cleaning (S7). Thereafter, the CPU 31 determines whether TC is larger than T1 (S8). Here there is executed a part of the function as drive means. Also when the CPU 31 determines that TB is smaller than T2 (N in S5), it determines whether TC is larger than T1 (S8).

When the CPU 31 determines that TC is larger than T1 (Y in S8), it executes suction cleaning (S9). Here there is executed a part of the function as drive means. Subsequently, the CPU 31 executes a printing operation (S10). Also when the CPU 31 determines that TC is smaller than T1, it executes the printing operation (S10).

Thereafter, the CPU 31 determines whether the printing operation is over (S11), and until termination of the printing operation, the CPU repeats the processes from step S1 to step S11 (N in S11).

T1, T2, and T3 are set so that for example the relationship of T1<T2<T3 is established. Consequently, the number of times of wiping operation (the number of times of rub cleaning) by the wiping unit 12 becomes smaller than the number of times of sucking operation (the number of times of suction cleaning) by the suction unit 13. Thus, the operation frequency of the wiping unit 12 which causes wear or damage of the nozzle surface 5 is kept low and it is possible to attain a long life of the ink jet head 4.

Figure 7:
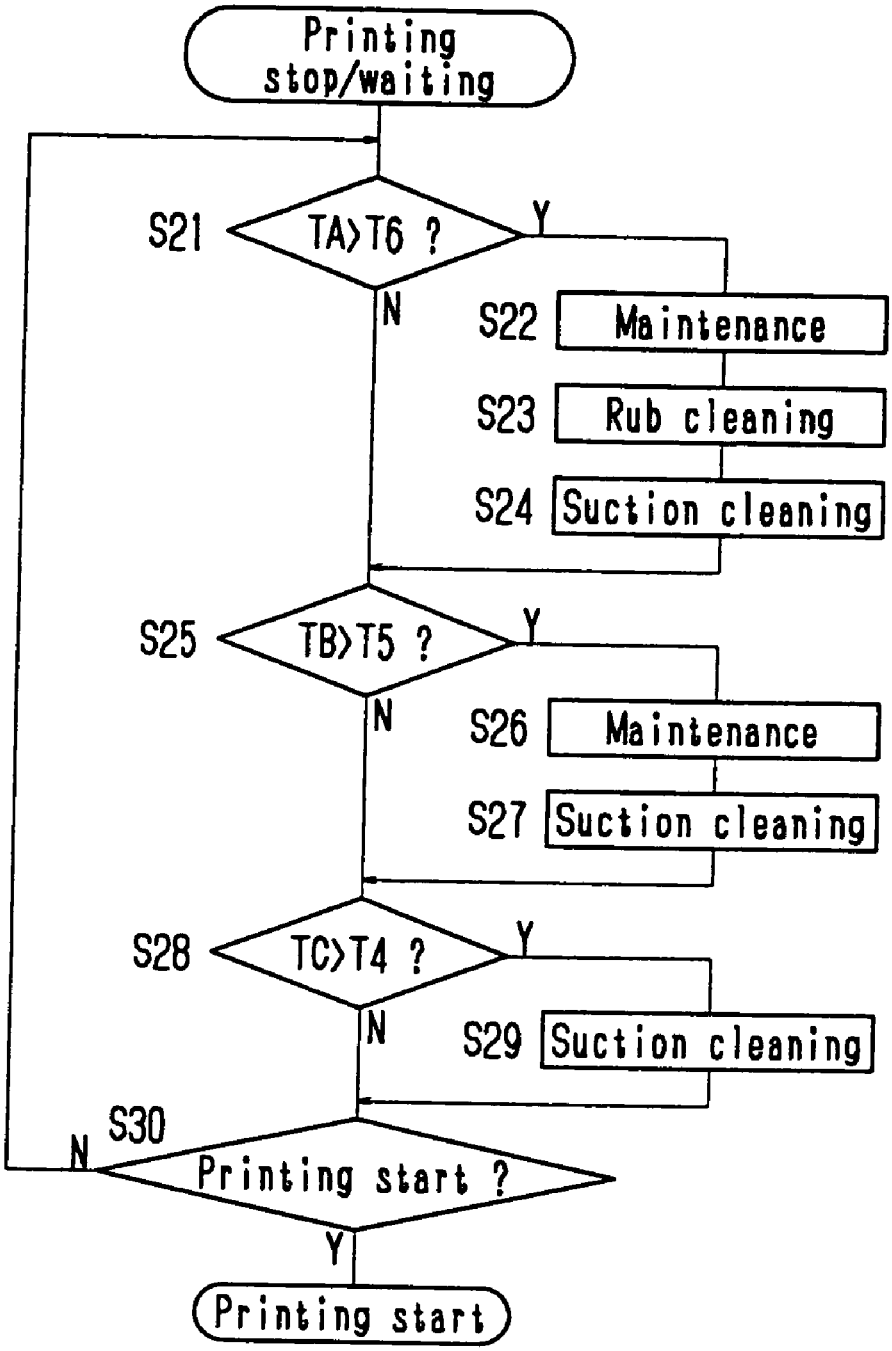
FIG. 7 is a flow chart showing a flow of a cleaning process during printing OFF or during waiting.

Next, with reference to FIG. 7, a description will be given of the cleaning process which the CPU 31 executes in accordance with a program during a short-time rest or during waiting for printing. FIG. 7 is a flow chart showing a flow of the cleaning process during a printing rest period or during waiting for printing.

The CPU 31 determines whether TA is larger than T6 (step S21). Here there is executed a part of the function as drive means. If the CPU 31 determines that TA is larger than T6 (Y in S21), it executes maintenance (S22), further executes rub cleaning (S23) and suction cleaning (S24). Here there is executed a part of the function as drive means. Although suction cleaning is executed in step S24, this constitutes no limitation. For example, suction cleaning may be omitted. Thereafter, the CPU 31 determines whether TB is larger than T5 (S25). Also when the CPU 31 determines that TA is smaller than T6 (N in S21), it determines whether TB is larger than T5 (S25).

When the CPU 31 determines that TB is larger than T5 (Y in S25), it executes maintenance (S26) and further executes suction cleaning (S27). Subsequently, the CPU 31 determines whether TC is larger than T4 (S28). Here there is executed a part of the function as drive means. Also when the CPU 31 determines that TB is smaller than T5 (N in S25), it determines whether TC is larger than T4 (S28).

When the CPU 31 determines that TC is larger than T4 (Y in S28), it executes suction cleaning (S29). Here there is executed a part of the function as drive means. Then, the CPU 31 determines whether a printing operation is started or not (S30), and until the start of a printing operation it repeats the processes from step S21 to step S30 (N in S30).

T4, T5, and T6 are set so that for example the relationship of T4<T5<T6 is established. As a result, the number of times of wiping operation (the number of times of rub cleaning) by the wiping unit 12 becomes smaller than the number of times of sucking operation (the number of time of suction cleaning) by the suction unit 13. Therefore, the operation frequency of the wiping unit 12 which causes wear or damage of the nozzle surface 5 is kept low and it is possible to attain a long life of the ink jet head 4.

Figure 8:
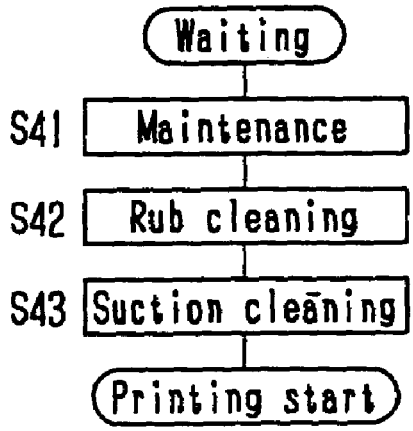
FIG. 8 is a flow chart showing a flow of a cleaning process after a long-time OFF condition.
Figure 10:
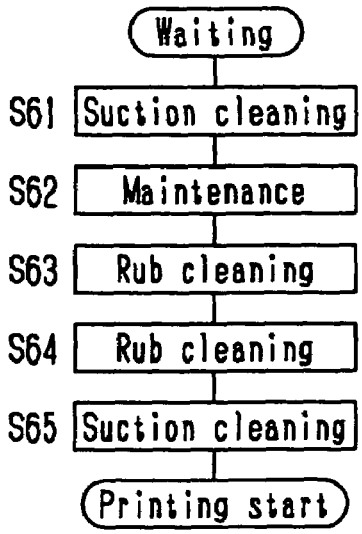
FIG. 10 is a flow chart showing a flow of a further cleaning process after a long-time OFF condition.
Figure 11:
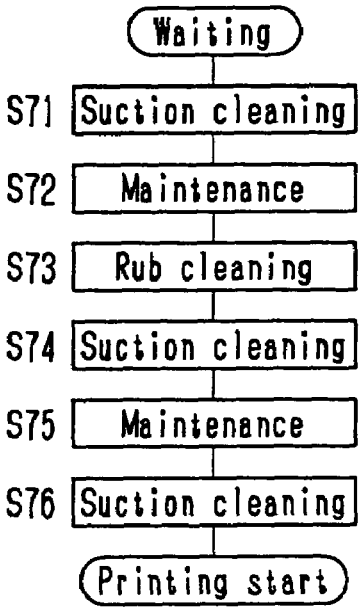
FIG. 11 is a flow chart showing a flow of a still further cleaning process after a long-time OFF condition.

Next, with reference to FIGS. 8 to 11, a description will be given of the cleaning process which the CPU 31 executes in accordance with a program during waiting for printing after a long-time rest (or during waiting for printing after forced cleaning). FIG. 8 is a flow chart showing a flow of the cleaning process after a long-time rest condition and FIGS. 9 to 11 are flow charts showing flows of other cleaning processes after a long-time rest.

The CPU 31 measures an OFF time of the ink jet recording apparatus 1, i.e., an ink ejecting operation OFF time of the ink jet head 4. Here there is executed the function as detector means.

Usually the CPU 31 determines whether the ink jet ejecting operation OFF time of the ink jet head 4 is longer than a predetermined time. Then, if the ink ejecting operation OFF time is longer than the predetermined time, that is, if the ink jet recording apparatus 1 is in a long-time rest condition, the CPU 31 executes maintenance (S41) and further executes rub cleaning (S42) and suction cleaning (S43), followed by start-up of printing (printing operation), as shown in FIG. 8. Here there is executed the function as drive means.

Figure 9:
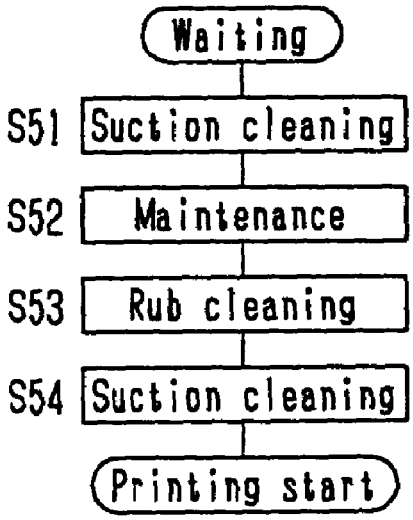
FIG. 9 is a flow chart showing a flow of another cleaning process after a long-time OFF condition.

If it is presumed that there is much foreign matters such as dust and dirt deposited on the nozzle surface 5 (if the OFF time of the ink jet head 4 is longer than the usual OFF time), the CPU 31, as shown in FIG. 9, executes suction cleaning (S51), maintenance (S52), rub cleaning (S53), and suction cleaning (S54), followed by start-up of printing (printing operation). In this process the wiping unit 12 and the suction unit 13 are operated selectively so that the number of times of wiping operation (the number of times of rub cleaning) becomes smaller than that of sucking operation (that of suction cleaning) by the suction unit 13. By so doing it is possible to keep low the operation frequency of the wiping section 12 which causes wear or damage of the nozzle surface 5, and attain a long life of the ink jet head 4.

If it is impossible to clear up a defect in printing, the CPU 31, as shown in FIG. 10, executes suction cleaning (S61), maintenance (S62), rub cleaning (S63), further executes rub cleaning (S64) and suction cleaning (S65). Thereafter, printing (printing operation) is started.

If there is a great influence of entry of foreign matters into the nozzles 3 by rub cleaning, the CPU 31, as shown in FIG. 11, executes suction cleaning (S71), maintenance (S72), sub cleaning (S73), suction cleaning (S74), further executes maintenance (S75) and suction cleaning (S76). Thereafter, printing (printing operation) is started. In this process, the wiping unit 12 and the suction unit 13 are operated selectively so that the number of times of wiping operation (the number of times of rub cleaning) by the wiping unit 12 becomes smaller than that of sucking operation (that of suction cleaning) by the suction unit 13. By so doing it is possible to keep low the operation frequency of the wiping unit 12 which causes wear or damage of the nozzle surface 5, and attain a long life of the ink jet head 4.

Although there is made construction such that the cleaning processes described above are carried out on the basis of various conditions, this constitutes no limitation. An appropriate cleaning process may be selected and carried out by an operator's operation for an operating unit (not shown) provided in the ink jet recording apparatus 1. Although the above cleaning processes are carried out by the CPU 31 in accordance with programs stored in ROM 32, no limitation is made thereto. For example, the cleaning processes may be carried out by hardware (e.g., a processing circuit).

In this embodiment, by thus operating the wiping unit 12 and the suction unit 13 selectively, it is possible to keep low the operation frequency of the suction unit 13 which is necessary for maintaining the nozzle surface 5 of the ink jet head 4 in good condition, also possible to suppress the consumption of energy, minimize the operation frequency of the wiping unit 12 which causes wear or damage of the nozzle surface 5, and attain a long life of the ink jet head 4. Further, by operating the wiping unit 12 and the suction unit 13 selectively it is possible to clean the ink jet head to a satisfactory extent and prevent deterioration of the ink ejection stability. As a result, it is possible to prevent the occurrence of a defect in printing.

Further, the wiping unit 12 is actuated, thereafter the suction unit 13 is actuated, whereby remaining ink generated due to unwiping of the nozzle surface 5 by the wiping unit 12 can be surely removed. Accordingly, deterioration of the ink ejection stability is prevented. As a result, it is possible to prevent the occurrence of a defect in printing. An unwiped portion in the wiping operation by the wiping unit 12 occurs depending on the material and structure of the wiping blade 15 and the accuracy (surface roughness and flatness) of the nozzle surface 5 of the ink jet head 4.

The CPU 31 further determines whether the ink ejecting operation OFF time of the ink jet head 4 is larger than a predetermined time, and if the answer is affirmative, the wiping unit 12 and the suction unit 13 are each operated. Therefore, even if the ink jet recording apparatus 1 is in a long-time rest condition, it is possible to effect cleaning of the ink jet head 4 to a satisfactory extent and surely prevent deterioration of the ink ejection stability.

Further, since the wiping unit 12 is made up of the wiping blade 15 as an abutting member and the first moving driver 16 for moving the ink jet head 4 and the wiping blade 15 in a relative manner, such a simple construction permits cleaning of the ink jet head 4 to a satisfactory extent and makes it possible to prevent deterioration of the ink ejection stability.

Likewise, since the suction unit 13 is made up of the suction head 19 which covers part of the plural orifices 11 and the second moving driver 20 which causes the ink jet head 4 and the suction head 19 to move relatively over the plural orifices 11, such a simple construction permits partial suction of the plural orifices 11 and affords a strong suction force.

Although in this embodiment the wiping blade 15 is moved by the first moving driver 15 and the suction head 19 is moved by the second moving driver 20, no limitation is made thereto. For example, the wiping blade 15 and the suction head 19 may be moved simultaneously by a single moving driver, whereby it is possible to attain the saving of space and the reduction of cost in comparison with the case where two moving drivers 16 and 20 are provided.

Although this embodiment is constructed such that the ink jet head 4 is moved to three predetermined positions (wiping position, sucking position, and maintenance position) to effect various cleaning operations (wiping operation, sucking operation, and maintenance operation), this constitutes no limitation. For example, the wiping unit 12, the suction unit 13, and the maintenance unit 14 may be moved to be slidable for the ink jet head 4 when stopped at the maintenance position to effect various cleaning operations.

Further, although in this embodiment the wiping blade 15 moves relative to the ink jet head 4, this constitutes no limitation. It suffices for the wiping blade 15 and the ink jet head 4 to move in a relative manner. For example, the ink jet head 4 may move relative to the wiping blade 15.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet head cleaning apparatus comprising:

a wiping unit adapted to perform a wiping operation on a nozzle surface of an ink jet head, said nozzle surface including at least one orifice from which ink is ejected as an ink droplet;

a suction unit adapted to perform a sucking operation on the nozzle surface of the ink jet head;

detector means for detecting an operation OFF condition of the wiping unit and an operation OFF condition of the suction unit; and drive means for selectively actuating the wiping unit and the suction unit in accordance with the OFF condition detected by the detector means;

wherein the detector means detects the operation OFF condition of the wiping unit by measuring an elapsed time after the wiping operation, and detects the operation OFF condition of the suction unit by measuring an elapsed time after the sucking operation;

wherein the drive means (i) determines whether the elapsed time after the wiping operation is longer than a first predetermined time, and actuates the wiping unit when the elapsed time after the wiping operation is determined to be longer than the first predetermined time, and (ii) determines whether the elapsed time after the sucking operation is longer than a second predetermined time, and actuates the suction unit when the elapsed time after the sucking operation is determined to be longer than the second predetermined time; and wherein the first predetermined time is longer than the second predetermined time.

2. The ink jet head cleaning apparatus according to claim 1, wherein the wiping unit comprises:

an abutting member having a front end which is adapted to abut against the nozzle surface of the ink jet head; and a moving driver which causes the abutting member to move with respect to the ink jet head along the nozzle surface.

3. The ink jet head cleaning apparatus according to claim 1, wherein the at least one orifice comprises a plurality of orifices, and the suction unit comprises:

a suction head which covers part of the plurality of orifices; and a moving driver which causes the suction head to move with respect to the ink jet head over the plurality of orifices.

4. An ink jet head cleaning method for cleaning an ink jet head comprising a nozzle surface including at least one orifice from which ink is ejected as an ink droplet, using a wiping unit adapted to perform a wiping operation for the nozzle surface and a suction unit adapted to perform a sucking operation on the nozzle surface, said method comprising:

detecting an operation OFF condition of the wiping unit by measuring an elapsed time after the wiping operation;

detecting an operation OFF condition of a suction unit by measuring an elapsed time after the sucking operation;

determining whether the elapsed time after the wiping operation is longer than a first predetermined time;

determining whether the elapsed time after the sucking operation is longer than a second predetermined time, said second predetermined time being shorter than the first predetermined time;

actuating the wiping unit and the suction unit when the elapsed time after the wiping operation is determined to be longer than the first predetermined time; and actuating the suction unit when the elapsed time after the sucking operation is determined to be longer than the second predetermined time.

* * * * *